US005734232A

United States Patent [19]

Hendrix et al.

[11] Patent Number: 5,734,232

[45] Date of Patent: Mar. 31, 1998

[54] CIRCUIT ARRANGEMENT

[75] Inventors: Machiel A. M. Hendrix; Eugen J. De Mol, both of Eindhoven, Netherlands

[73] Assignee: U.S. Philips Corporation, New York, N.Y.

[21] Appl. No.: 742,687

[22] Filed: Oct. 31, 1996

[30] Foreign Application Priority Data

Nov. 7, 1995 [NL] Netherlands ..... 09500915

[51] Int. Cl.[6] ..... G05F 1/00

[52] U.S. Cl. ..... 315/307; 315/224; 315/209 R; 315/DIG. 7; 363/47

[58] Field of Search ..... 315/307, 209 R, 315/224, DIG. 4, DIG. 5, DIG. 7; 363/47, 39

[56] References Cited

U.S. PATENT DOCUMENTS

| | | | |
|---|---|---|---|
| 4,727,297 | 2/1988 | Wolze | 315/307 |
| 4,791,338 | 12/1988 | Dean et al. | 315/174 |
| 5,382,881 | 1/1995 | Farkas et al. | 315/307 |
| 5,485,061 | 1/1996 | Ukita et al. | 315/307 |
| 5,491,387 | 2/1996 | Saito | 315/307 |

FOREIGN PATENT DOCUMENTS

0605052A1 7/1994 European Pat. Off. .

4412510A1 10/1994 Germany .

*Primary Examiner*—Robert Pascal
*Assistant Examiner*—Haissa Philogene
*Attorney, Agent, or Firm*—Edward Blocker

[57] ABSTRACT

The invention relates to a circuit arrangement for operating a low-pressure discharge lamp. The circuit arrangement according to the invention comprises means X for supplying the low-pressure discharge lamp, provided with means X1 for generating a current of changing polarity. The circuit arrangement also comprises a feedback network which together with the means X and the low-pressure discharge lamp forms a control loop for controlling a lamp condition parameter. A low-pass filter is included in the control loop. The feedback network is provided with means M for generating a signal m which represents the instantaneous value of the lamp condition parameter, means C for comparing the signal m with a reference signal d, and means S for controlling the means X in dependence on the result of the comparison. The circuit arrangement according to the invention has the characteristic that the control loop has a transfer function with a bandwidth which is small at a comparatively high power consumed by the lamp compared with that at a comparatively low power. Unstable behavior of the control loop is counteracted thereby.

5 Claims, 1 Drawing Sheet

CIRCUIT ARRANGEMENT

BACKGROUND OF THE INVENTION

Figure 1:
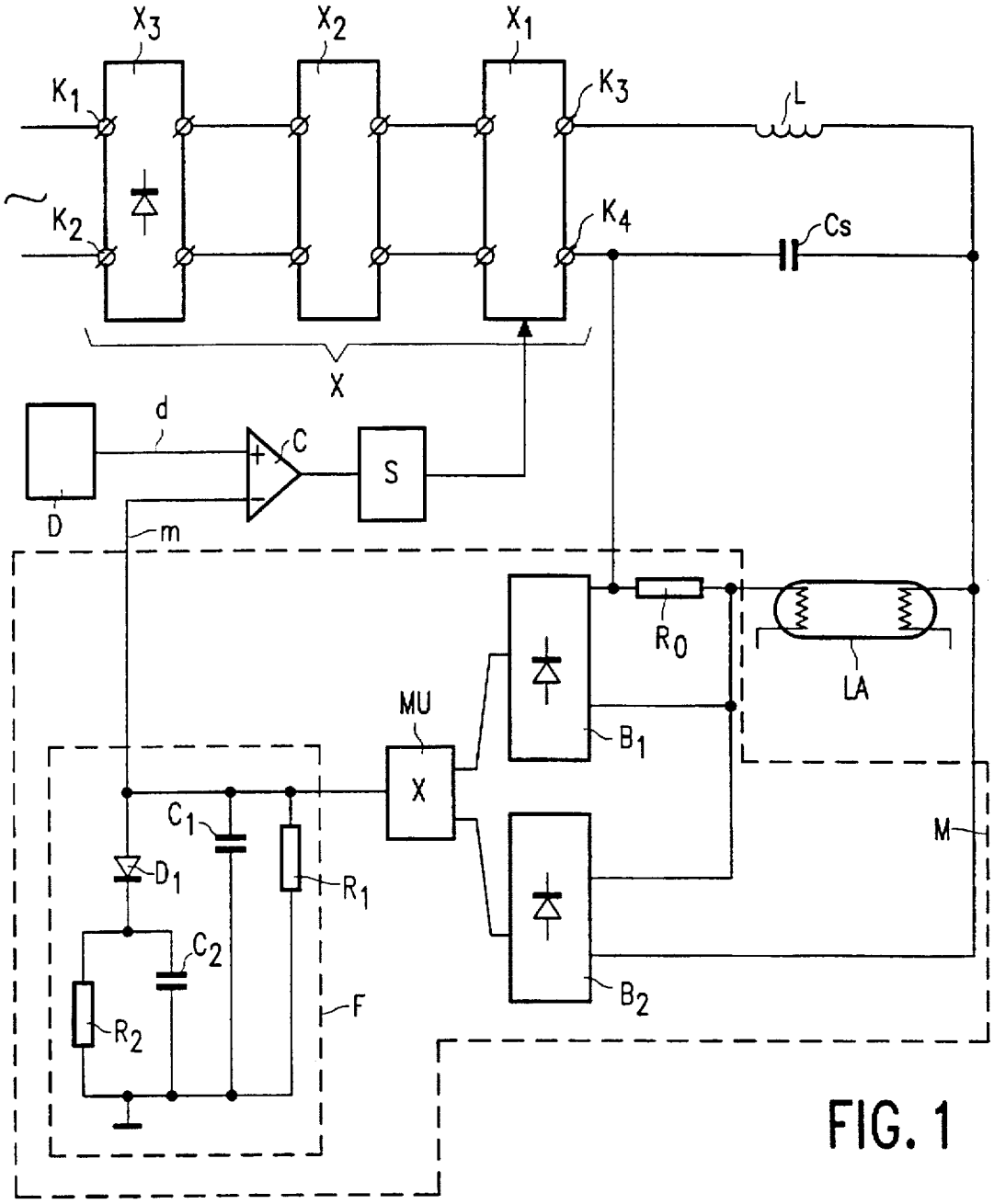

The invention relates to a circuit arrangement for operating a low-pressure discharge lamp, comprising:

means X for supplying the low-pressure discharge lamp, provided with means X1 for generating a current of changing polarity, input terminals for connecting a supply source, and lamp connection terminals for connecting the low-pressure discharge lamp;

a feedback network forming a control loop together with the means X and the low-pressure discharge lamp for controlling a lamp condition parameter, in which control loop a low-pass filter F is included, while the feedback network is provided with means M for generating a signal m which represents the instantaneous value of the lamp condition parameter, means C for comparing the signal m with a reference signal d, means S for controlling the means X in dependence on the result of the comparison.

Such a circuit arrangement is known from U.S. Pat. No. 5,382,881. The controlled lamp condition parameter is the lamp current in the known circuit arrangement. The lamp current, and thus the luminous flux unequivocally related thereto over a comparatively wide range, can be adjusted by means of the reference signal. The means X1 in the known circuit arrangement are formed by a half-bridge circuit. The average lamp current is controlled by means of the frequency with which the means X1 make the current change its polarity. To determine the instantaneous value of the average lamp current, the circuit arrangement comprises a resistor in series with the lamp and a rectifier for determining the absolute value of the voltage across the resistor. A low-pass filter is included in the control loop at the output of the rectifier. The low-pass filter has a resistive impedance in series with a capacitive impedance. The former introduces a zero point into the transfer function of the filter which compensates for frequency-dependent characteristics of the lamp, and thus counteracts "moding". "Moding" is an unstable behavior of the control loop according to which it changes its setpoint periodically. A disadvantage of the known circuit arrangement is, however, that unstable behavior takes place in the form of oscillation around a setpoint of the control loop especially at higher lamp powers, such as at nominal operation of the lamp. Both forms of unstable behavior are disadvantageous because they can manifest themselves as an audible resonance of the lamp and/or of components of the circuit. Fluctuations in the luminous flux as a result of unstable behavior may interfere with infrared-operated equipment and may in addition be visible at low fluctuation frequencies.

SUMMARY OF THE INVENTION

It is an object of the invention to provide a circuit arrangement of the kind mentioned in the opening paragraph in which both forms of unstable behavior are counteracted.

According to the invention, the circuit arrangement of the kind described in the opening paragraph is for this purpose characterized in that the control loop has a transfer function with a bandwidth which is small at a comparatively high power consumed by the lamp as compared with the bandwidth at a comparatively low power. It was found that this measure counteracts both moding of the control loop and the occurrence of oscillations in the control loop at higher lamp powers. The bandwidth in the present description and claims is defined as the frequency interval within which the open loop amplification of the control loop is at least 50% of that prevailing at a frequency of 0 Hz. It was found to be sufficient when the bandwidth of the control loop decreases in a single step from a value for lower powers to a value for higher powers. If so desired, however, the bandwidth may decrease in several steps or gradually with an increase in the power consumed by the lamp.

It was found in the case of tubular low-pressure discharge lamps that moding occurs sooner in proportion as the diameter of the discharge vessel is smaller and as the lamps are operated at a lower power. A favorable embodiment of the circuit arrangement according to the invention is characterized in that the bandwidth at a nominal power consumed by the lamp is at least 10 times smaller than the bandwidth at a power which is 25% of the nominal power. This embodiment of the circuit arrangement also renders it possible to control the lamp power over a comparatively wide range without unstable behavior occurring in lamps of comparatively small diameter.

A practical embodiment of the circuit arrangement according to the invention is characterized in that the filter F of the control loop has a branch which is non-operative in a portion of a range over which the lamp power is controllable.

In a favorable modification of this embodiment, the filter F is provided with a branch which has an impedance and which is connected in series with a voltage-dependent element. In an implementation of this modification, the voltage-dependent element has, for example, a resistance value which decreases with the voltage across it, while the signal to be filtered has an average value which increases with the power consumed by the lamp. For example, the voltage-dependent element is a diode or a zener diode, and the signal to be filtered is a signal which represents the lamp current. At a comparatively low power consumed by the lamp, the average value of the signal to be filtered is also low, so that the voltage-dependent element is non-conducting. The impedance connected in series with the voltage-dependent element is non-operative then and accordingly does not contribute to the action of the filter. As the power consumed by the lamp rises, the average value of the signal also rises, and thus the conductance of the voltage-dependent element, so that the impedance will start contributing to the filter action. In another implementation of said modification, the voltage-dependent element has, for example, a resistance which increases with the voltage across it, while the signal to be filtered has an average value which decreases as the power consumed by the lamp increases.

A very favorable embodiment is characterized in that the filter F has an impedance which is shunted by a switching element of which a control electrode is connected to the signal m which represents the instantaneous value of the power consumed by the lamp. When the switching element is in the conducting state, the shunted impedance is non-operative and accordingly does not contribute to the filter action. This embodiment is also suitable when the signal to be filtered is not a measure for the power. In that case, the control electrode of the switching element may be connected to the output of a separate signal source which generates a signal which is a measure for the power.

The control circuit S may influence, for example, the operation of the means X1, for example via the switching frequency. Alternatively, the control circuit may affect another sub-circuit of the means X. For example, the control circuit may control a circuit which supplies a supply voltage to the means X1.

It is immaterial to the invention whether means D for generating a reference signal d representing the desired value of the lamp condition parameter are integral, for example partly integral, with the circuit arrangement, or whether signal transfer to the circuit arrangement takes place in a different manner, for example via a cable. The reference signal may be generated, for example, by automatic control means, for example time-dependent control means. Alternatively, the means D may provide an additional or exclusive possibility for being operated by a user by means of controls. In the latter case, said controls are preferably electrically separated from the circuit arrangement, signal transfer taking place, for example, via a transformer, an optocoupler, or remote control.

BRIEF DESCRIPTION OF THE DRAWING FIGURES

Figure 2:
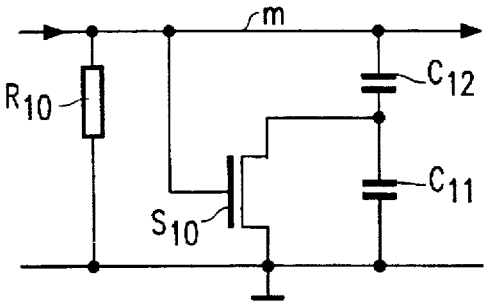

These and other aspects of the circuit arrangement according to the invention will be explained in more detail with reference to the drawing, in which FIG. 1 is a block diagram of a first embodiment of the circuit arrangement according to the invention, and FIG. 2 shows a detail of a second embodiment.

DESCRIPTION OF THE INVENTION

In the embodiment shown in FIG. 1, the circuit arrangement comprises means X for supplying the low-pressure discharge lamp, provided with means X1 for generating a current of changing polarity and input terminals K1, K2 for connecting a supply source. A low-pressure discharge lamp LA is connected to lamp connection terminals K3, K4 of the circuit arrangement via an inductive impedance L and a resistive impedance R0 which serves as a current sensor. The series arrangement of the lamp LA and current sensor R0 is shunted by a capacitive impedance CS.

The lamp in this embodiment has cold cathodes, i.e. the electrodes are not given additional heating during operation and during lamp ignition. The current through the lamp may be measured in the case of heated electrodes, for example, by means of a circuit as described in the earlier Application PHN 15.354.

In the embodiment shown, the means X in addition comprise a diode bridge X3 for rectifying a mains voltage, and a preconditioner X2 which converts the rectified mains voltage into a voltage of higher value.

The circuit arrangement shown further comprises a feedback network which forms together with the means X and the lamp LA a control loop for controlling a lamp condition parameter. The lamp condition parameter here is the average value of the product of the absolute value of the current through and the absolute value of the voltage across the lamp, which forms a fair approximation of the power consumed by the lamp. In an alternative embodiment, the controlled lamp condition parameter is, for example, the average value of the current through the lamp, or the luminous flux generated by the lamp. The feedback network is provided with means M for generating a signal m which represents the instantaneous value of the lamp condition parameter. The means M comprise besides the current sensor R0, a first and a second rectifier B1, B2, a multiplier MU and a low-pass filter F. The voltage across the current sensor R0 is rectified by the first rectifier B1. The voltage across the lamp is rectified by the second rectifier B2. The product of the voltages obtained from the multiplier MU is filtered with the low-pass filter F. Although the filter F in the embodiment shown forms part of the feedback network, it may alternatively be included, for example partly, in a different location in the control loop. In an embodiment, for example, the filter is arranged between the means C and S.

The feedback network further comprises means C for comparing the signal representing the measured value m of the lamp condition parameter with a reference signal d representing the desired value. The reference signal d is generated by means D and transferred to means C via a cable and a transformer. The transformer provides an electrical separation between the means D and the components of the circuit arrangement.

The feedback network further comprises means S for controlling means X, i.e. the means X1, in dependence on the result of the comparison between the signals m and d. The means S comprise an oscillator whose frequency depends on the voltage supplied to the means S.

The circuit arrangement has the characteristic that the control loop has a transfer function with a bandwidth which is small at a comparatively high power consumed by the lamp compared with that at a comparatively low power.

This is realized in the embodiment shown in that the filter F of the control loop comprises a branch which is non-operative in a portion of a range over which the lamp power is controllable.

In this case the filter F is provided with a series arrangement of a voltage-dependent element, here a diode D1, and a branch comprising an impedance, here a resistor R2 shunted by a capacitor C2. The series arrangement is shunted both by a resistor R1 and by a capacitor C1. At a low lamp power, the voltage across the filter is low and the diode is non-conducting. The filter behavior is then determined by the resistor R1 and capacitor C1. As the power consumed by the lamp rises, the voltage across the filter rises. The diode D1 becomes conducting at a sufficiently high voltage, and the components R2 and C2 then play an active role in the filter. The bandwidth of the control loop is reduced thereby.

In a practical implementation of this embodiment, the resistors R1 and R2 have respective values of 39 kΩ and 390 kΩ. The capacitive impedances C1 and C2 have values of 1.5 nF and 330 nF. The diode is of the BAT85 type.

The bandwidth of this filter is 13.5 Hz at nominal lamp operation and 2.7 kHz at an operation at 25% of the nominal power. The bandwidth at a nominal power consumed by the lamp is accordingly at least 10 times smaller than that at a power which is 25% of the nominal power. A low-pressure mercury lamp with a nominal power of 15 W was operated by means of the circuit arrangement shown. On the one hand, moding of the control loop did not take place, even while the lamp was operated in an ambient temperature of 0° C. and a lamp current of 10 Ma. On the other hand, the lamp and the circuit components did not show any resonances also at nominal operation.

In a second embodiment of the circuit arrangement according to the invention, the filter F comprises an impedance C11 shunted by a switching element S10 of which a control electrode is connected to the signal m. In another embodiment, for example an embodiment in which the signal m is not related to the lamp power, the control electrode is connected to separate means for generating a signal which is a measure for the power. In the embodiment shown, the impedance C11 is connected in series with a further capacitive impedance C12. The series arrangement of C11 and C12 is shunted by a resistive impedance R10. In a practical implementation, the resistive impedance R10 and the capacitive impedances C11 and C12 are a 39 kΩ resistor, a 1.5 nF capacitor, and a 330 nF capacitor, respectively. The switching element S10 is a MOSFET of the BS107 type. During nominal lamp operation the voltage across the filter is 2.9 V. The switching element is conducting then, and the filter has a bandwidth of 12 Hz. The signal value drops to 0.9 V at a lamp power of 50% of the nominal power, whereby the switching element is switched off. The filter has a bandwidth of 2.7 kHz then. Accordingly, the bandwidth accompanying a nominal power consumed by the lamp is at least 10 times smaller than that accompanying a power which is 25% of the nominal power. The control loop showed no moding during operation, also at a low lamp power, and no resonances could be observed at a nominal load on the lamp.

We claim:

1. A circuit arrangement for operating a low-pressure discharge lamp, comprising:

means X for supplying the low-pressure discharge lamp, provided with means X1 for generating a current of changing polarity, input terminals for connecting a supply source, and lamp connection terminals for connecting the low-pressure discharge lamp;

a feedback network forming a control loop together with the means X and the low-pressure discharge lamp for controlling a lamp condition parameter, in which control loop a low-pass filter F is included, while the feedback network is provided with means M for generating a signal m which represents the instantaneous value of the lamp condition parameter, means C for comparing the signal m with a reference signal d, means S for controlling the means X in dependence on the result of the comparison, characterized in that the control loop has a transfer function with a bandwidth which is small at a comparatively high power consumed by the lamp as compared with the bandwidth at a comparatively low power.

2. A circuit arrangement as claimed in claim 1, characterized in that the bandwidth at a nominal power consumed by the lamp is at least 10 times smaller than the bandwidth at a power which is 25% of the nominal power.

3. A circuit arrangement as claimed in claim 1, characterized in that the filter F of the control loop has a branch which is non-operative in a portion of a range over which the lamp power is controllable.

4. A circuit arrangement as claimed in claim 3, characterized in that the filter F is provided with a branch which has an impedance R2, C2 and which is connected in series with a voltage-dependent element D1.

5. A circuit arrangement as claimed in claim 3, characterized in that the filter F has an impedance C11 which is shunted by a switching element S10 of which a control electrode is connected to the signal m.

* * * * *